US006445146B1

(12) United States Patent
Bergström et al.

(10) Patent No.: US 6,445,146 B1
(45) Date of Patent: Sep. 3, 2002

(54) METHOD OF REDUCING AXIAL BEAM FOCUSING

(75) Inventors: Jan Olof Bergström; Stig Lindbäck, both of Uppsala (SE)

(73) Assignee: Gems Pet Systems AB, Uppsala (SE)

( * ) Notice: Subject to any disclaimer, the term of this patent is extended or adjusted under 35 U.S.C. 154(b) by 0 days.

(21) Appl. No.: 09/787,880

(22) PCT Filed: Sep. 28, 1999

(86) PCT No.: PCT/SE99/01710

§ 371 (c)(1),
(2), (4) Date: Nov. 2, 1999

(87) PCT Pub. No.: WO00/19786

PCT Pub. Date: Apr. 6, 2000

(30) Foreign Application Priority Data

Sep. 29, 1998 (SE) ..... 9803303

(51) Int. Cl.[7] ..... H05H 13/00

(52) U.S. Cl. ..... 315/502; 315/507; 313/60; 313/359.1

(58) Field of Search ..... 315/502, 507; 313/62, 359.1

(56) References Cited

U.S. PATENT DOCUMENTS 4,771,208 A * 9/1988 Jongen et al. ..... 313/62
6,057,655 A * 5/2000 Jongen ..... 315/502

FOREIGN PATENT DOCUMENTS

WO 99/07864 A1 5/1991

OTHER PUBLICATIONS

Proceedings of the 1989 IEEE Particle Accelerator Conference Accelerator Science & Technology, vol. 1, pp. 675–677.

Proceedings of the 1997 IEEE Particle Accelerator Conference, vol. 1, (1998), pp. 1060–1062.

IEEE Transactions on Magnetics, vol. 32, No. 4, Jul. 1996, pp. 2194–2196.

* cited by examiner

*Primary Examiner*—Bruce Anderson
*Assistant Examiner*—Nikita Wells
(74) *Attorney, Agent, or Firm*—Birch, Stewart, Kolasch & Birch, LLP

(57) ABSTRACT

A method is disclosed for minimising the diameter of the magnet poles of a cyclotron system for production of radioactive tracers. The method selects an operation mode having $v_z$ defined below the critical resonance value of $v_z$=½ and chooses a valley technique having shallow valleys by selecting a first magnet pole parameter defining a valley gap accepting a narrow spaced RF electrode system and size facilitating a vacuum conductance necessary for obtaining a low enough pressure. The method then defines a second magnet pole parameter by setting a sector gap size. The magnetic azimuthal field shape is transformed from being "square-wave"-shaped to becoming approximately sinusoidal by increasing the magnetising field. Then an average magnetic field is calculated from the increased magnetising field and the first and second magnet pole parameter. A pole diameter can then be established to obtain a most compact design of the electromagnet for a cyclotron system. A cyclotron system in accordance with the method is also disclosed.

6 Claims, 3 Drawing Sheets

METHOD OF REDUCING AXIAL BEAM FOCUSING

This application is the national phase under 35 U.S.C. § 371 of PCT International Application No. PCT/SE99/01710 which has an International filing date of Sep. 28, 1999, which designated the United States of America and was published in English.

TECHNICAL FIELD

The present invention relates to a method and system for minimising the magnet size in a cyclotron.

BACKGROUND OF THE INVENTION

Production of radioisotopes normally takes place by means of a suitable particle accelerator, for instance a cyclotron, in which an ion beam (i.e., a beam of charged particles) is accelerated. The radioisotopes are formed via nuclear reactions between an incident ion beam and a target medium, which can be a pressurised gas, a liquid or a solid.

Cyclotrons make use of a magnetic field for deflection of accelerated ions into circular orbits. The ion beam will pick up energy successively in the acceleration process and the ion beam trace will become a multi-turn spiral until the ions have reached their final energy at the edge of the magnet poles. The relatively long spiral beam path in the magnet field calls for ion beam focusing properties of the magnet field in order to keep the ion beam concentrated. Modern cyclotrons make use of so called "sector focusing" by means of shaping sectors in the magnet poles for obtaining an improved ion beam axial focusing. This is achieved by dividing the pole surface of the magnet into sectors normally three or four per pole, i.e., 6 or 8 totally. The regions presenting a larger distance between the poles are then referred to as "valleys".

The acceleration of ions in a cyclotron is performed via a so called RF electrode system maintained at a high radio frequency (RF) voltage, which oscillates with a period time (or a multiple thereof) corresponding to the orbit revolution time of the beam in the cyclotron as given by the average magnetic field of the cyclotron magnet system and the mass/charge ratio of the accelerated ions. Originally the shape of the RF electrodes was like two opposite "D"-formed hollow electrodes in which an accelerated ion beam orbits dependent of the applied magnetic field and the energy of the ions. Every time the beam enters and leaves one electrode, it gains energy and then increases the radius of its orbit.

An ion beam make many orbit revolutions in the acceleration vacuum space between the magnet's poles while increasing its orbit radius. Finally the beam will be extracted from its orbit at the edge of the magnet pole to be incident onto the specific target material. The magnetic field is stronger in the sector regions than in the valley regions due to the different pole gaps. The bigger the difference in magnetic field strength between sectors and valleys, the stronger the axial beam focusing will be, but as a result the average magnetic field will of course be less, which demands a larger diameter of the magnet to ensure its desired energy.

In order to make the cyclotron as compact as possible (i.e., having a small pole diameter) the average magnetic field must be kept high. This implies that the magnet pole gap should be kept as small as possible. This in turn keeps electrical power consumption low, but directly two undesirable effects arise:

Firstly, there will be a reduced conductance in the pole gap for vacuum pumping and secondly there will be very little space for the RF acceleration electrodes.

The nature of the first effect refers to the fact that reduced opening areas has a negative effect on the vacuum pumping conductance leading to deterioration of the vacuum. The accelerated ions in the case of an isotope production facility for PET (Positron Emission Tomography) have a negative charge created by an additional electron bound to the atom. The binding force of the additional electron is weak and the electron will easily be "knocked off" in interactions between the accelerated ions and vacuum rest gas elements. The "hit" ion will be irreversibly neutralised, loosing its sensitivity for electrical and magnetic fields and get lost. A lower vacuum conductance leads to higher amounts of rest gasses, thus resulting in higher beam losses and vice versa. This is a very important factor particularly in the case of a radioactive tracer production system for PET demanding acceleration of negative hydrogen ions.

The second problem can to some extent be compensated for by placing the RF acceleration electrodes in the valleys where the magnet gap is the largest, thereby also keeping the loading capacitance down for the RF acceleration electrodes which is advantageous from the RF power consumption point of view. The obvious solution should be to keep the distance between the sectors small in order to keep the high magnetic field in sector areas and to expand the valley gap in some extent to create a better environment for the RF acceleration electrodes and at the same time get a better pumping conductance.

However, as already noted above, if the valley gap gets too large, the magnetic field strength in the valley gets too small relative to the sector field strength and the axial beam focusing as expressed by $v_z$ (number of axial ion beam oscillations per orbit revolution) will increase and eventually get into the $v_z=½$ resonance which prohibits stable beam acceleration.

Some modern cyclotrons (<20 MeV proton energy) are based on the so called "deep valley" design, where the pole consists of large (thick) sector plates fixed directly onto the magnet yoke, yielding very large valley gaps suitable for the RF electrodes, and in this type of cyclotrons the value of $v_z$ stays well above the resonance value $v_z=½$. Such cyclotrons will have a lower magnetic average field depending on the large valley gaps resulting in a larger pole radius for any given ion energy and, hence, such cyclotrons will be physically larger than a design based on a $v_z$ value below the $v_z=½$ resonance. More extensive information on this is for example to be found in "Principles of cyclic particle accelerators", by John J. Livingood (D. Van Nostrand Company, Inc., Princeton, N.J., USA).

Consequently, there are two alternatives available in designing a compact cyclotron magnet, namely to either choose a value of $v_z$ well below 0.5 or well above 0.5 to stay away from the mentioned critical $v_z=½$ resonance.

The first choice results in a compact magnet but a design with too small valley gaps to satisfy the demands of a low power RF system and a satisfactory vacuum conductance while the other choice results in too large a magnet in order to fulfil the size requirements. The best average design option for a compact cyclotron magnet seems to be obsolete due to the restrictions related to axial focusing.

Therefore there is a demand of a method for cyclotron design for optimising the size of a cyclotron device applicable for a PET Isotope Production facility which takes into account the opposing parameters to allow a very compact device suitable, for instance, for installation at a local hospital where limited space is the normal case. The compactness of the cyclotron itself will also then promote small overall size of the system including the integrated radiation shield, which could be the golden standard for such equipment in the future. There is also a demand for a system taking advantage of such a method.

SHORT DESCRIPTION OF THE INVENTION

A method is disclosed for minimising the size of the magnet system and especially the diameter of the magnet poles of a cyclotron system for production of radioactive tracers. The method and a cyclotron according to the method make use of an operation mode having $v_z$ well below the critical resonance value of $v_z$=½. Firstly, the sector gap is fixed at a small value (typically 15–30 mm) giving relatively few ampere-turns. Secondly, the valley pole gap is fixed at a value large enough to give good vacuum pumping conductance and to house a narrow spaced RF electrode system with acceptable capacitance and power consumption. For medium field strengths the value of $v_z$ will now be lower than $v_z$=½ but still too close. The method now involves the step of raising the ampere-turns/coil current such that the sector field becomes greater than the saturation value for soft steel, which is approximately 2.15 Tesla. This will have two desirable effects on the value of $v_z$:

1. The valley field will increase more than proportional relative to the sector field due to the saturation effects in the sectors.
2. The azimuthal field shape is transferred from being "square-wave" shaped to becoming approximately sinusoidal.

The method is set forth by the independent claim 1 and further steps are defined by the dependent claims 2 and 3. A cyclotron system in accordance to the disclosed method is set forth by the independent claim 4 and further embodiments a set forth by the dependent claims 5 and 6.

SHORT DESCRIPTION OF THE DRAWINGS

The objects, features and advantages of the present invention as mentioned above will become apparent from the description of the invention in conjunction with the following drawings, in which same or equal elements will be denoted by the same numerals, and wherein.

DESCRIPTION OF AN ILLUSTRATIVE EMBODIMENT

According to the present inventive improvements, a cyclotron device being applicable for a PET Isotope Production facility is disclosed. The device according to the present invention takes into account opposing parameters thereby facilitating a very compact design. This design will commonly be referred to as the "MINItrace" device. The MINItrace device at the same time also constitutes an Integrated Radiation Shield for a PET isotope production system for creating short lived radioactive tracers used in medical diagnostics.

Figure 1:
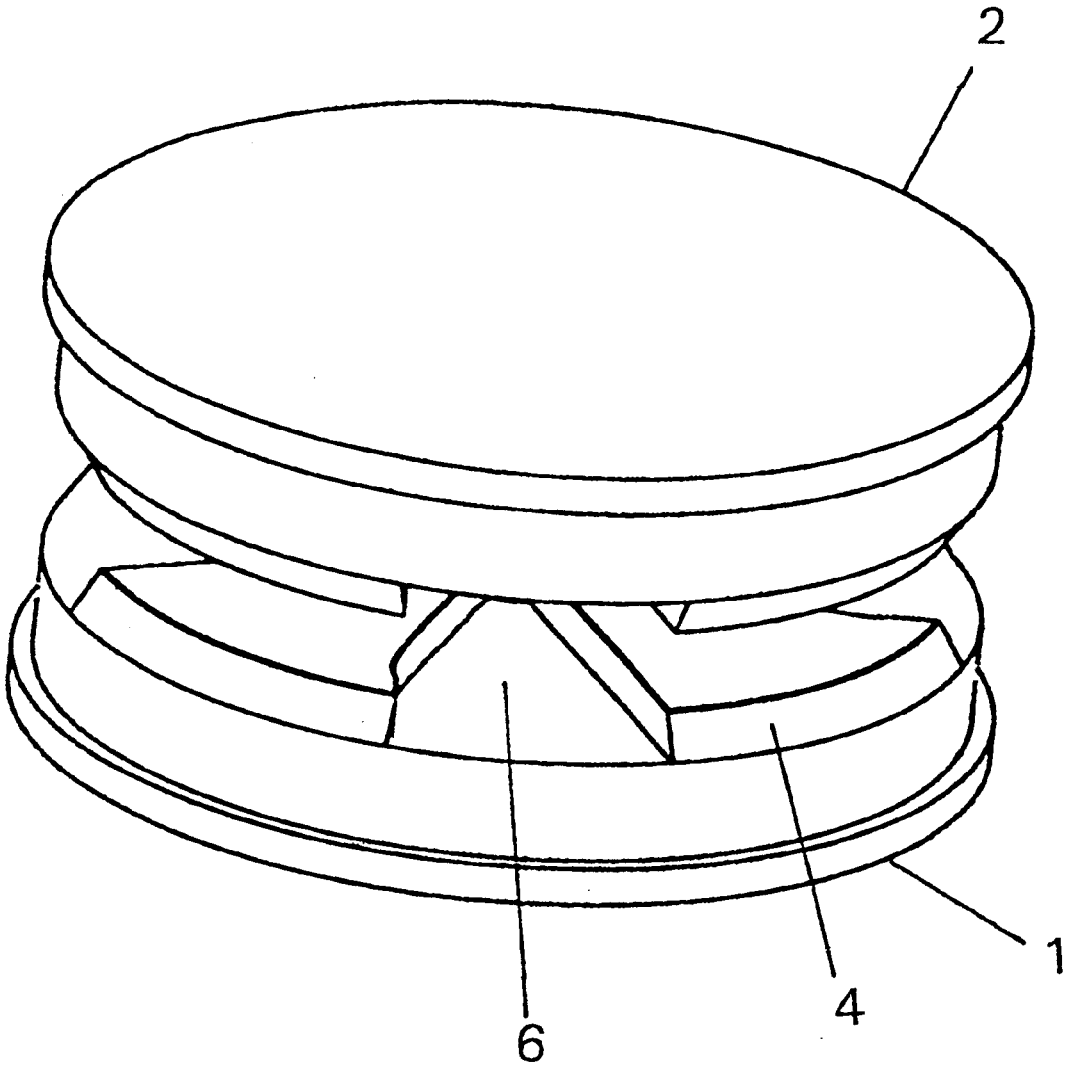
FIG. 1 illustrates a three dimensional view of a pair of magnet poles intended for a compact cyclotron according to the present invention.
Figure 2:
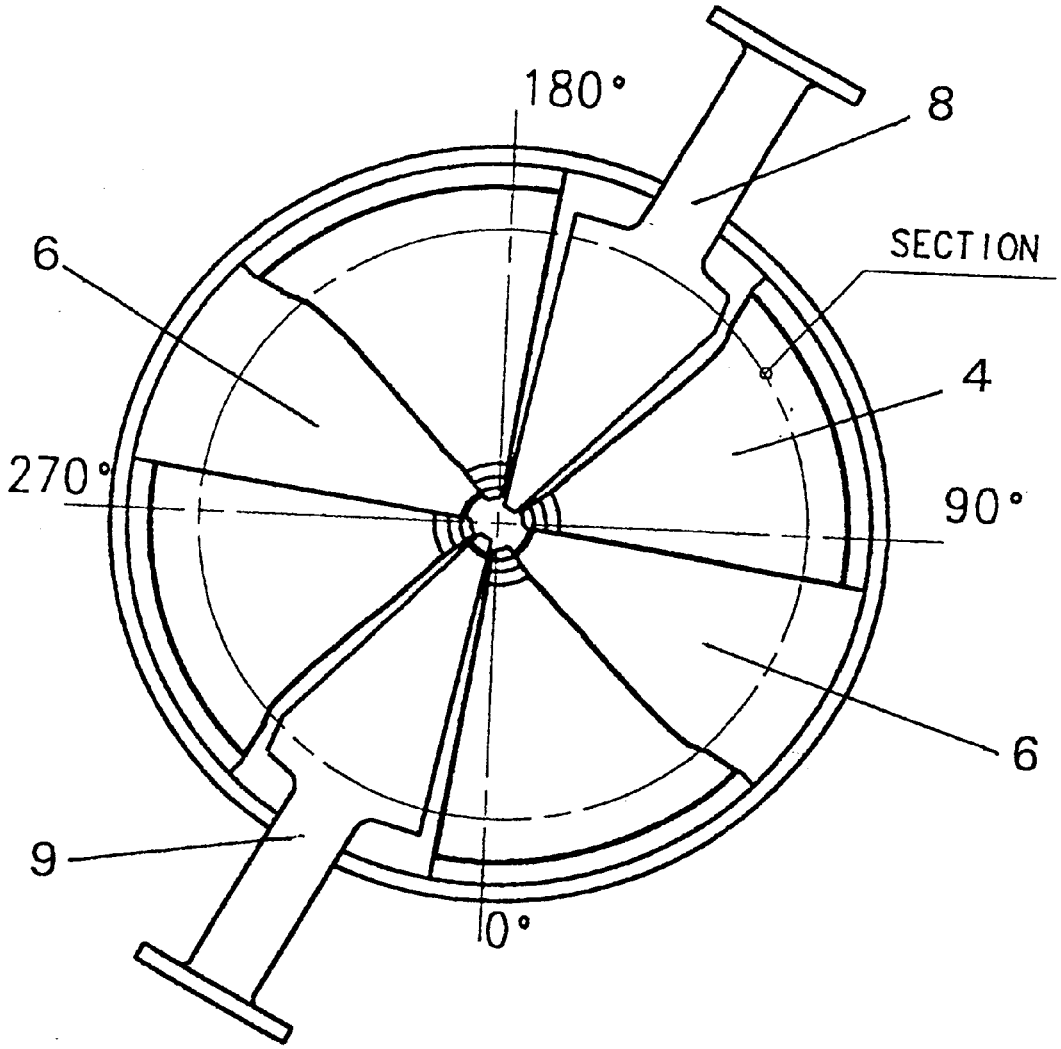
FIG. 2 illustrates the sectors of a lower magnet pole in a top view as seen from the upper magnet pole and illustrating also portions of acceleration RF electrodes in two of the valleys.

However, the MINItrace compact magnet design is based on a $v_z$ value below 0.5 but still with satisfactory space for the RF electrodes and good vacuum conductance. A system according to this new concept will be described below:

FIG. 1 illustrates a pair of magnet poles, a first magnet pole 1 and a second magnet pole 2 for use in a cyclotron according to an illustrative embodiment of the present invention. Both magnet poles present the same number of sectors 4, e.g. four sectors as shown in the disclosed embodiment. Between the pole sectors 4 valleys 6 are created. Consequently there are then found four valleys 6 in the illustrative embodiment. An electromagnetic field is created between the magnet poles 1 and 2 by means of coils (not shown) arranged on a yoke (not shown), the coil windings being fed with high electric current to thereby form a strong electromagnet generating a magnetic field utilised for deflecting and focusing an ion beam in the cyclotron device. In FIG. 2 the first magnet pole 1 is depicted in a plane parallel to the sector surfaces 4. FIG. 2 also illustrates that in two of the shallow valleys created, a respective portion of two pairs of acceleration RF electrodes 8, 9 is positioned. It may also be noted in the disclosed embodiment that the surface area of the sectors 4 is larger than the area of the valleys 6.

It has been common in cyclotrons to limit sector field strengths to be below the saturation value for soft steel, which is expected at a field-strength of about 2.15 Tesla. However, by increasing the field strength on the sectors by making the magnet coils larger and providing more ampere-turns, two effects will occur, both of which reduce the value of $v_z$.

Due to the fully saturated sector steel there will be a considerable magnetic stray field "leaking" into the valleys which results in a proportionally larger increase of the valley field than of the sector field. This reduces axial focusing, i.e. the value of $v_z$ will decrease.

Figure 3:
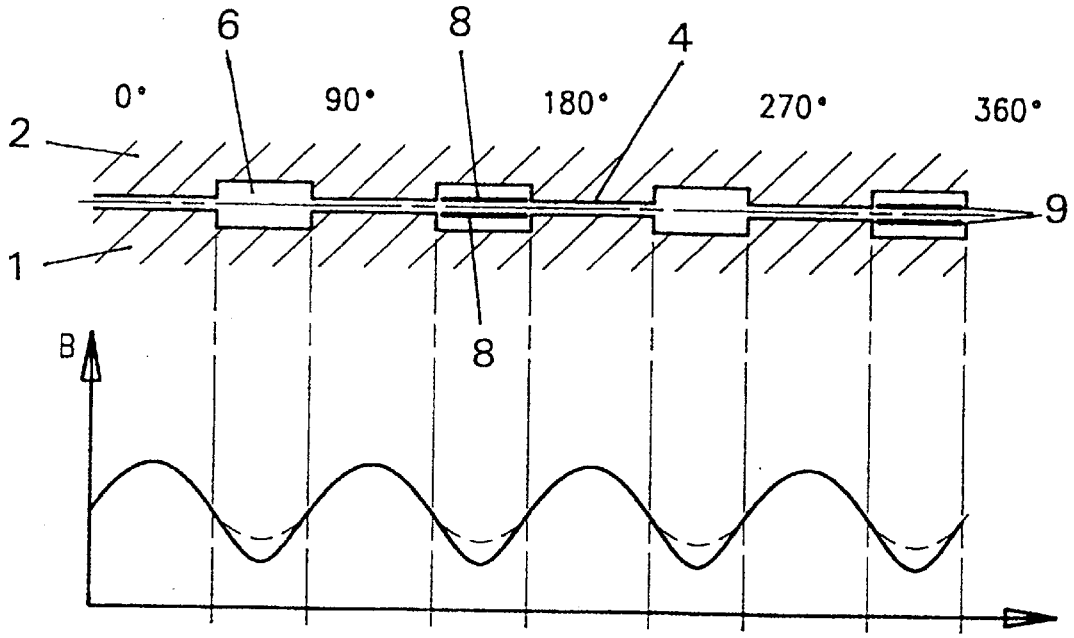
FIG. 3 illustrates the variation of the magnetic field along a portion of an ion beam trace in a device according to the present invention.

In FIG. 3, a variation of the magnetic field B in the median plane is depicted along an approximately circular trace between the two magnet poles 1 and 2. In the pole valleys positioned in the angular range 90–180 and in the angular range 270–360 there are then indicated RF accelerating electrodes providing a similar gap for the ion beam as the gap distance between opposing pole sectors 4.

By increasing the sector field the azimuthal field shape will transform from being "square-wave" shaped to becoming sinusodial due to saturation effects. Such a change of field shape will further reduce the value of $v_2$:

By utilising this approach it is then possible to choose a larger valley gap than would have been possible with a conventional sector magnet field and still keep $v_z$ well below the $v_z$=½ resonance. The total result of such an approach is a more compact magnet system for a cyclotron for a PET isotope production system in a respect that the diameter of the cyclotron can be reduced.

To further improve maintenance and access to the magnet pole system and for instance to a centrally arranged ion source (not shown) and the extraction system (not shown), the electromagnets preferably are positioned such, that the plane of the magnet poles 1 and 2 is positioned vertical, which facilitates a simple separation of the magnet poles by means of a set of vertically mounted hinges arranged with the magnet yoke. The result will be that, when the magnet poles are separated for maintenance access, the first magnet pole 1 will be seen in a position equal to that of FIG. 2. The RF electrodes 8 and 9 may then still be one unit consisting of both the upper and lower electrode plates between which an ion beam is to be accelerated. This separation is performed by releasing the vacuum of the vacuum casing in which the magnet poles are positioned and by means of the set of hinges divide the vacuum casing into two portions, one containing the first magnet pole 1 and the RF electrode system 8 and 9 and another pivotal portion containing the second magnet pole 2.

The RF electrodes then are conventionally fed with one terminal connection to the both electrodes 8 and 9 and the counter terminal connection to both of the magnet poles.

Table 1 illustrates a design scheme for the method according to the present inventive improvements of a cyclotron device being applicable for a PET Isotope Production facility.

This table shows the main differences between the present method and the typical method according to the state of the art relying on the so-called deep valley technique.

TABLE 1

| | | |
|---|---|---|
| Select deep valley technique | No<br>↓<br>Deep valley technique will not promote compact design<br>↓ | Yes<br>↓<br>Dead end |
| Promote highly saturated sectors | Yes<br>↓ | No<br>↓ |
| Select valley gap | Size of gap will define the important constraints for the RF systems and vacuum conductance<br>↓ | Size of gap will define the important constraints for the RF systems and vacuum conductance<br>↓ |
| Define parameters | Set sector gap (15–30 mm)<br>↓ | Define max. magnet field (2.15 Tesla)<br>↓ |
| Magnet modelling | Raise magnetising field until the sector/valley field ratio for acceptable axial focusing<br>↓<br>Calculate average magnet field<br>↓<br>Calculate pole radius<br>↓ | Calculate minimum sector gap fulfilling the sector/valley field ratio for acceptable axial focusing<br>↓<br>Calculate average magnet field<br>↓<br>Calculate pole radius<br>↓ |
| Most compact design | Yes | No |

A preferred embodiment of a cyclotron device in agreement with the present inventive improvement presents a maximum diameter of 700 mm for the magnet poles illustrated in FIG. 1. The height of each pole is then about 120 mm and an effective physical radius of a sector 4 will then be of the order 320 mm due to the bevel cut edge. Such a magnet pole consists of low level carbonised steel constituting the material forming the pole sectors 4 and at the same time exhibiting the valleys 6. FIGS. 1 and 2 does not show the yoke carrying the electric coils. The yoke is divided by means of hinges, which means that the two opposing magnet poles 1 and 2 can be separated by, in a horizontal plane, pivoting one half of the yoke by means of its hinges. In the pivoted position the magnet pole 1 will be accessed as is illustrated in FIG. 2. The division of the yoke is performed with a high accuracy to eliminate any possible air gap, besides when applying the strong magnet field that will also be acting to eliminate any air gap.

The cyclotron according to the preferred embodiment will accelerate negative hydrogen ions up to an energy of the order 10 MeV after the ion beam has been accelerated during about 80 revolutions by the induced RF voltage over the RF electrodes in the electromagnetic field. The device is designed as a fourth harmonic accelerator device, i.e., it will use four periods of the accelerating RF voltage during one orbit revolution of the ion beam. The operating RF frequency will then be slightly above 100 MHz. The design having the RF electrode system positioned in two opposing valleys results in giving the ion beam four energy pushes every revolution. In the preferred embodiment a sector 4 takes about 55° and a valley will then be of the order of 35°. The two RF electrodes each consists of two opposing copper plates having their opposing surfaces at a distance similar to the gap distance between the pole sectors when the yoke is closed. The RF electrodes are designed to fit into the two valleys such that a proper high-tension insulation can be maintained in regard of the applied high frequency field. The RF electrodes will of course also constitute a capacitor relative to the copper plated material of the magnet surrounding those. The inductance of the RF structure will together with stray capacitances of the RF electrodes present a resonance frequency which should be matched to the desired operating RF frequency for maximum transfer of RF power to the RF accelerating system for obtaining a highest possible RF accelerating field.

The high frequency field applied to the RF electrode system is a fixed frequency unmodulated sinusoidal RF signal, which means that the cyclotron according to the disclosed embodiment will operate as an isochronous sector focused system. The RF generation system is controlled by means of a feedback system to maintain an optimum matching of the system. A cyclotron controller system also controls the electromagnetic field in relation to the accelerating RF field frequency for obtaining the optimum operation conditions for the created beam of negative hydrogen ions.

A suitable ion source will already be well known to a person skilled in the art of ion acceleration devices and such a device will therefore not be further discussed in this context.

As will be obvious to a person skilled in the art the magnetic field may be further acted upon for compensation of several known influences, which will not be further discussed here as it is considered not being a part of the present invention, but can be found in the literature.

The illustrated embodiment of the present invention is not to be seen in any respect as limiting the spirit and scope of the presently disclosed method and system but defined by the accompanying claims.

We claim:

1. A method for minimising the size of magnet poles of a cyclotron system for production of radioactive tracers comprising the steps of:

selecting an operation mode having $v_z$ defined below the critical resonance value of $v_z=½$;

choosing then a valley technique having more shallow valleys instead of deep valleys by selecting a first magnet pole parameter defining a valley gap accepting a narrow spaced RF electrode system and facilitating a vacuum conductance necessary for obtaining low enough pressure suitable for acceleration of negative hydrogen ions, defining a second magnet pole parameter by setting a sector gap to the order 15–30 mm facilitating a vacuum conductance necessary for obtaining a low enough pressure suitable in an accelerator for negative hydrogen ions;

increasing the magnetising field for transforming a magnetic azimuthal field shape from being "square-wave" shaped to become approximately sinusodial;

calculating from the increased magnetising field and the first and second magnet pole parameter an average magnet field;

calculating from the average magnet field a third magnet pole parameter in the form of a pole diameter, thereby obtaining the most compact design of an electromagnet system for the cyclotron system.

2. The method according to claim 1, comprising the further step of increasing the magnetising sector field by utilising a high degree of saturation in the magnet sector material while still keeping valley regions below saturation, whereby due to saturation effects further reducing a value of $v_z$.

3. The method according to claim 2, comprising the further step of selecting magnet poles presenting four equally sized sector gaps and four corresponding valley regions, each valley being of the order 2/3 of the corresponding magnet sector.

4. A system presenting a minimised diameter of the magnet poles of a cyclotron for acceleration of negative hydrogen ions for production radioactive tracers, comprising an electromagnet system consisting of a pair of coils and a yoke including a first (1) and a second (2) circular magnet pole presenting pole sectors (4) and valley regions (6), at least two opposing valley sectors containing RF acceleration electrodes (8, 9) and the first and second magnet poles (1, 2) and the included RF electrodes (8, 9) being positioned in a vacuum casing for forming a cyclotron accelerating system for negative ions released from a central ion source when applying a proper RF accelerating voltage to the RF electrodes (8, 9), whereby an ion beam is deflected and focused between the first and second magnet poles by an applied strong magnet field by means of the electromagnet system;

whereby each magnet pole forms four sector portions and four valley portions, the distance between the four sector portions being of the order 15–30 mm for creating a high magnetic field with a low number of Ampere-turns and a distance in the four valleys for allowing a suitable space for the ion beam vacuum conductance for achieving a necessary vacuum when accelerating the ion beam; and the electromagnetic field being adapted to saturate the four sector portions but not the valleys to transform an azimuthal magnetic field shape from being "square-wave"-shaped to becoming approximately sinusodial.

5. The system according to claim 4, wherein the operation mode is chosen to be a mode which operates with a $v_z$ below the critical resonance value of $v_z$=½.

6. The system according to claim 5, wherein the maximum diameter of the circular magnet poles is of the order 700 mm for achieving a compact cyclotron system for the production of radioactive tracers for medical diagnostics, in particular for Positron Emission Tomography.

* * * * *